US005611765A

United States Patent [19]

Koch, Jr.

[11] Patent Number: 5,611,765

[45] Date of Patent: Mar. 18, 1997

[54] EXERCISE DEVICE

[76] Inventor: Frederick W. Koch, Jr., 1235 Chanticleer Dr., Cherry Hill, N.J. 08003

[21] Appl. No.: 530,828

[22] Filed: Sep. 20, 1995

Related U.S. Application Data

[63] Continuation of Ser. No. 210,439, Mar. 21, 1994, abandoned.

[51] Int. Cl.[6] ..... A63B 26/00

[52] U.S. Cl. ..... 482/142; 482/140; 606/240

[58] Field of Search ..... 482/140, 142; 606/240; 5/633

[56] References Cited

U.S. PATENT DOCUMENTS 3,006,643 10/1961 Ryan ..... 482/142
4,531,730 7/1985 Chenera ..... 482/142
4,597,386 7/1986 Goldstein ..... 5/633
4,838,249 6/1989 Jannotta ..... 606/240
5,180,386 1/1993 Kennedy, Jr. ..... 606/240

*Primary Examiner*—Lynne A. Reichard
*Attorney, Agent, or Firm*—Max Goldman

[57] ABSTRACT

A unitary exercise device provides exercise of the upper and lower abdominal muscles and the lower back muscles over the full range of motion of the muscles. It is lightweight and portable and is used without any other equipment or devices. The exercise device is rectangular in shape with two end sections having inclined surfaces. The angle of the inclined surfaces determines the amount of strength required to perform the exercises as the exerciser lies on the device. Therefore, the device can accommodate individuals with stronger or weaker muscles by changing the angle of the inclined surfaces of the end sections of the device.

9 Claims, 7 Drawing Sheets

EXERCISE DEVICE

This application is a continuation of application Ser. No. 08/210,439, filed Mar. 21, 1994 now abandoned.

BACKGROUND OF THE INVENTION

This invention relates generally to exercise equipment and more specifically to exercise devices which strengthen the abdominal muscles (the Rectus Abdominous, The Internal and External Obliques and the Transverse Abdominous), and the lower back muscles.

In general, a muscle is strongest at its mid-range of motion. When human beings stand up straight, the muscles of the torso at the center section of the body, which hold the body upright, are in their strongest position, and allow for functional movement bending forward and backward. Most abdominal exercise programs work the abdominal motions from a flat floor. This only brings into play one half of the motion of the muscles, leaving a large weakness in the muscle itself that could develop into numerous back and hip problems.

The abdominal muscles can work or bend the spine over a range from 30° extension back through center, or the neutral position, to 25° flexion forward of the neutral position. The function of the abdominal muscles is to bend the spine. The abdominal muscles are in four segments, each of which corresponds to a vertebrae on the back. Therefore, when the top abdominal segment contracts, it bends the third and fifth thoracic vertebrae with a pivot point between them. Then when the second abdominal segment contracts, it bends the fifth and sixth thoracic vertebrae and the pivot point moves down between them and so on, until we reach full spinal flexion.

A device for strengthening the abdominal muscles is disclosed in U.S. Pat. No. 4,372,553 (Hatfield). The device comprises a bench with a curved back on which the exerciser sits. A harness is attached to the shoulders of the exerciser with a cable holding weights so that when the exerciser pulls down, he or she is working against the weight resistance. This device is not fully effective in exercising the abdominal muscles because the hip flexures can do most of the work in pulling the torso forward and down, rather than the abdominal muscles. In addition, the Hatfield device does not provide any exercise for the lower abdominal or the lower back muscles.

Another device for exercising the abdominal muscles is disclosed in U.S. Pat. No. 4,752,067 (Colonello). This device comprises a specially shaped cradle-like basin with hand grips. The basin is shaped so that it can rock back and forth. Because the rocking motion is obtained by pulling the body up using the arms, again, the abdominal muscles do not do the full work with regard to extension and flexion. Additionally, the device does not cause abdominal muscles to move through their full range of motion nor does it provide exercise for the lower abdominal muscles or the back muscles.

There is a need for an exercise device which exercises the abdominal muscles over their full range of motion, which makes the abdominal muscles work fully, and which exercises the lower abdominal muscle and the lower back muscles as well as the upper abdominal muscles.

OBJECTS OF THE INVENTION

Accordingly, it is the general object of the instant invention to provide a device for exercising the upper and lower abdominal muscles and the lower back muscles which overcomes the shortcomings of present devices.

It is a further object of the instant invention to provide a device for exercising the upper and lower abdominal muscles and the lower back muscles which allows for the exercise of the muscles through a more complete range of motion.

It is yet a further object of the instant invention to provide a device for exercising the upper and lower abdominal muscles and the lower back muscles which can be sized to accommodate the strength of the muscles of the exerciser.

It is still yet a further object of the instant invention to provide a device for exercising the upper and lower abdominal muscles and the lower back muscles which is unitary and which requires no other devices or equipment to perform its functions.

It is another object of the instant invention to provide a device for exercising the upper and lower abdominal muscles and the lower back muscles which forces the muscles to do the work, and isolates the muscles during exercise.

It is still another object of the instant invention to provide a device for exercising the upper and lower abdominal muscles and the lower back muscles which is lightweight, portable, easy to carry and store.

It is still yet another object of the instant invention to provide a device for exercising the upper and lower abdominal muscles and the lower back muscles which is easy and inexpensive to manufacture.

SUMMARY OF THE INVENTION

These and other objects of the instant invention are achieved by providing a lightweight, portable, unitary and free-standing device which has a flat central portion and two inclined end portions. The exerciser lies on the device, with his back over the flat central portion, and his upper body against the surface of one of the inclined end sections. This provides a full bending backwards of the spine. As the exerciser lifts his body, the weight of his body applies force to the abdominal muscles which are used to raise the torso of the exerciser to an upright position. Additionally, if the legs, rather than the torso, of the exerciser are raised, the lower abdominal muscles are fully exercised. Finally, the lower back muscles can be exercised by lying face-down with the stomach on the flat central portion of the device and raising the upper torso from the floor.

DESCRIPTION OF THE DRAWINGS

Other objects and many of the intended advantages of this invention will be readily appreciated when the same becomes better understood by reference to the following detailed description, when considered in connection with the accompanying drawings wherein.

DETAILED DESCRIPTION OF THE PREFERRED EMBODIMENTS

Figure 1:
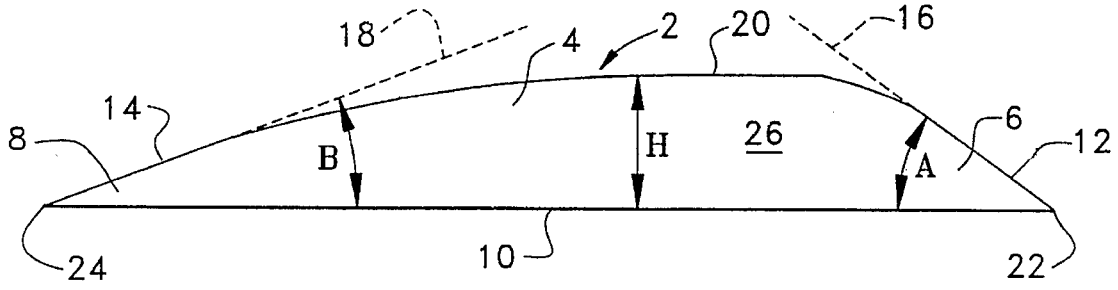
FIG. 1 is a side view of the device.
Figure 2:
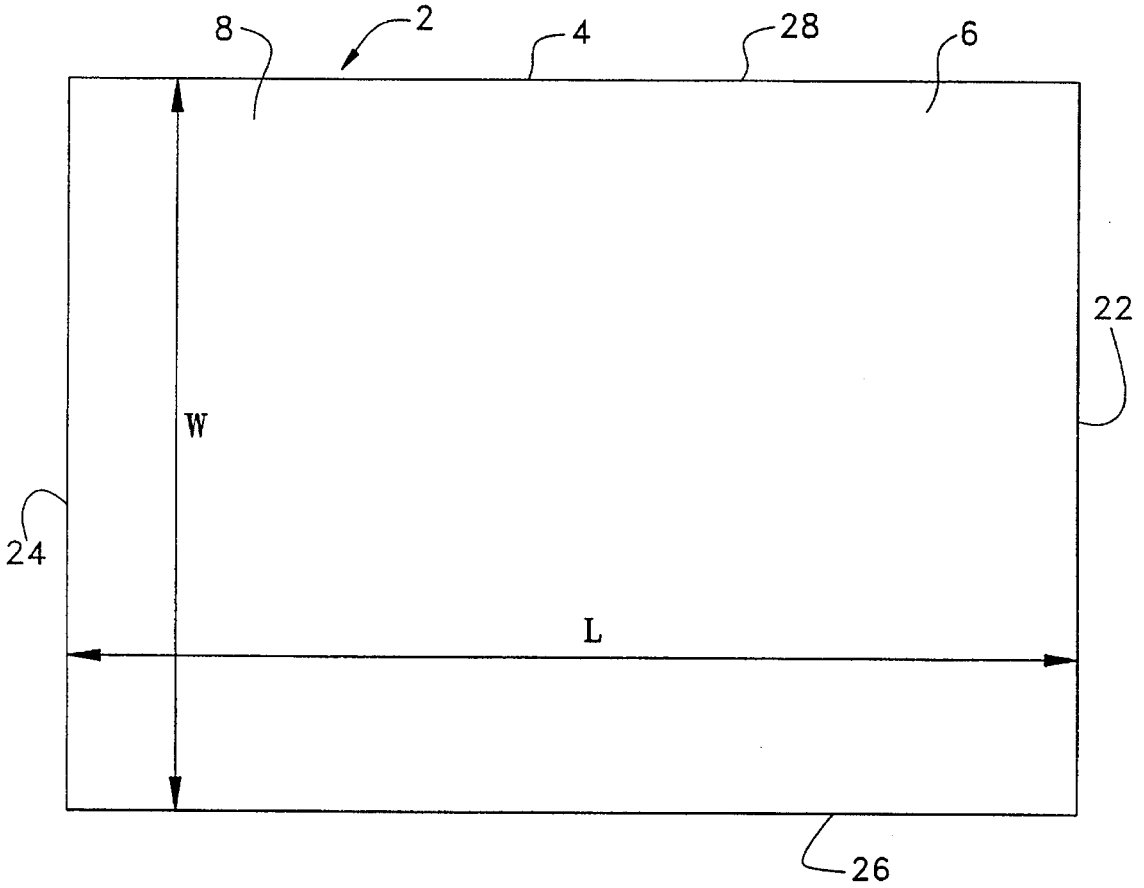
FIG. 2 is a top plan view of the device.

Referring now in greater detail to the various figures of the drawing, wherein like reference characters refer to like parts, there is shown in FIG. 1 the exercise device 2 of the, which is free-standing, instant invention. The device 2 comprises a central section 4, opposing end sections 6 and 8, a bottom wall 10, and opposing side walls 26. The central section 4 has a generally flat surface 20 which lies in a plane parallel to the plane of the bottom wall 10. The end section 6 has a sloping surface 12 which meets the bottom wall 10 at an end 22. Similarly, end section 8 has a sloping surface 14 which meets the bottom wall 10 at an end 24. The device 2 is shown positioned on a floor 29.

The exercise device 2 is preferably made of a resilient lightweight material such as foam rubber or closed cell foam. Alternatively, rubber or elastomeric materials can be used. Exemplary sizes of the device 2 are 16 inches in length L and 12 inches in width W, although other sizes can be used. A typical height H for the device 2, i.e., the distance between the bottom wall 10 and the surface 20, is approximately 1½ to 3 inches. These dimensions are exemplary and other dimensions can be used.

The angle A, which is the angle between the plane 16 (shown dashed) of the inclined surface 12, and the plane of the bottom wall 10, is 35° to 55° in the embodiment shown. The angle B which is the angle between the plane 18 of the inclined surface 14 and the bottom wall 10 is approximately 15° to 35° in this embodiment.

At this point, it should be noted that the angles of the inclined surfaces of the end sections can be chosen to suit the exerciser. The steeper the angle, the more effort is required by the muscles of the exerciser to perform the exercise. Therefore, for beginners with relatively weak muscles, the incline should be gradual, and for persons with greater muscle strength, the incline should be made steeper. It therefore should be kept in mind that in the diagrams which follow, the exerciser can place his or her legs at either end of the device depending upon the strength of the muscles of the exerciser and the strenuousness of the exercise desired. In general, the angles A and B can be at any value between 15 and 60 degrees to accommodate the muscular strength of the exerciser.

Figure 3:
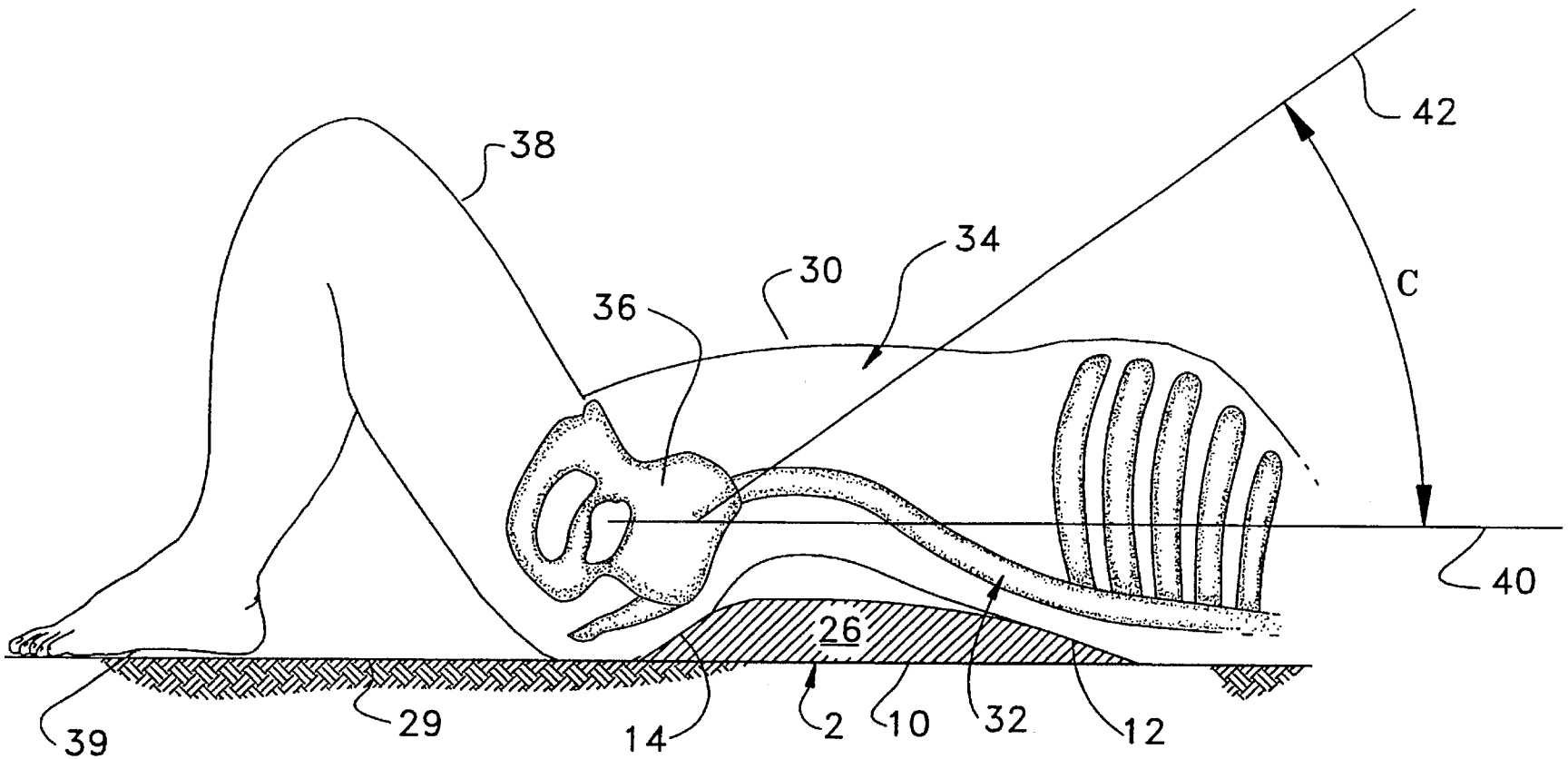
FIG. 3 shows the position of the body of the exerciser on the device for exercising the abdominal muscles.

In FIG. 3, the position of the exerciser 30 on the exercise device 2 for exercising the upper abdominal muscles 34 is shown. Also shown is the pelvis 36 and the spine 32 of the exerciser. It should be noted that the placement of the torso of the exerciser 30 against the inclined surface 14 and the inclined surface 12 bends the spine 32 backward and allows for a full range of motion as the exerciser 30 moves his or her torso upwards by contraction of the abdominal muscles 34 against the weight of the exerciser. Also, as can be seen in the figure, the legs 38 of the exerciser are bent with the soles 39 of the feet of the exerciser against the floor.

The plane 40 of the body of the exerciser at the backward extension position in FIG. 3, moves upward to the plane 42, which is the neutral position, as shown by angle C. The angle C is approximately 25° to 35°.

Figure 4:
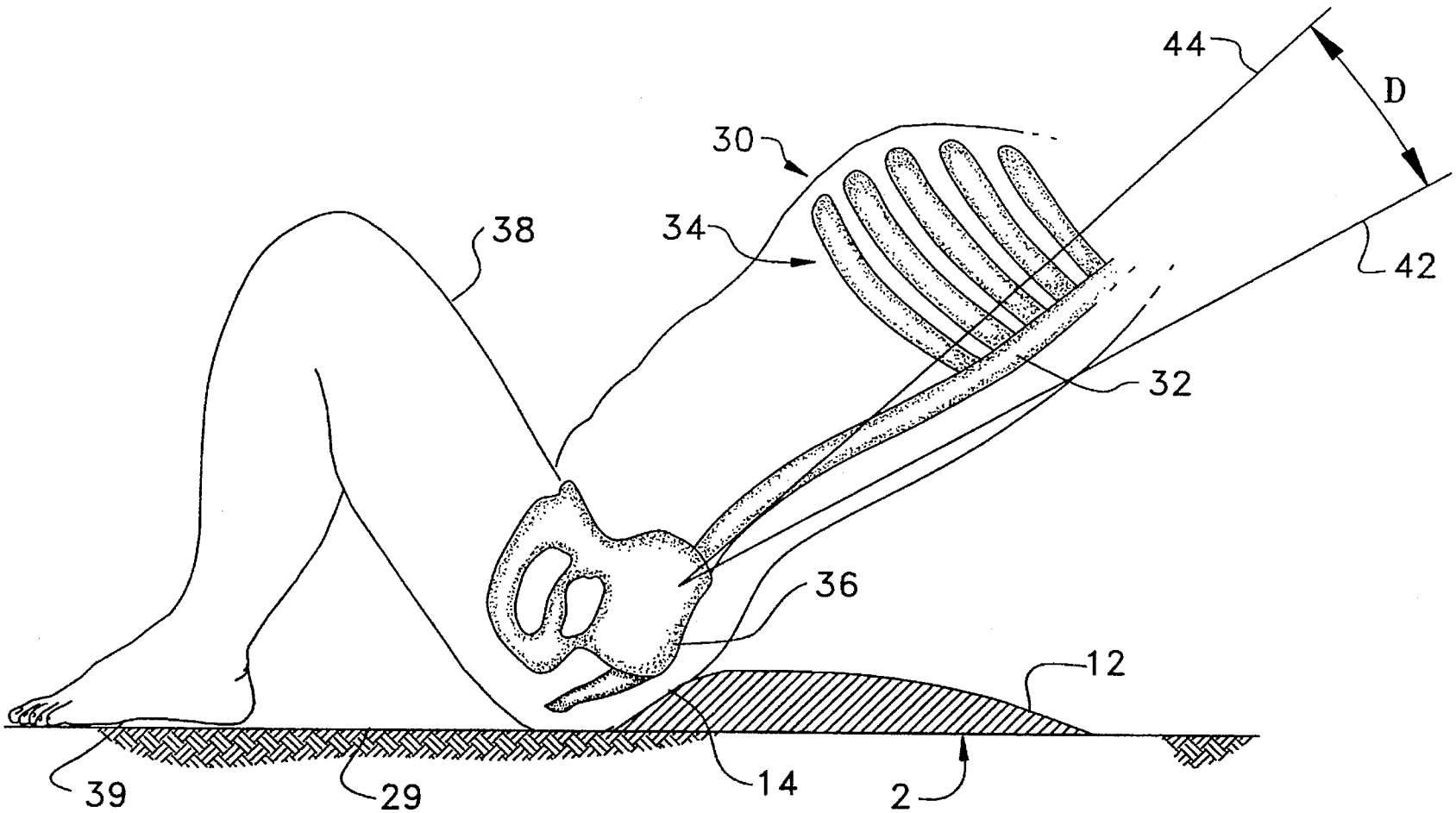
FIG. 4 shows the position of the raised upper torso of the exerciser at the end of the upward motion of the torso.

FIG. 4 shows the forward range of motion between the plane 42 of the body at the neutral position to the plane 44 of the body at the forward position. The forward range of motion, i.e., the angle D, is approximately 25°. The exercise of the upper abdominal muscles is performed by an iterative movement from the backward extension position to the flexion position and back again as shown in FIGS. 3 and 4.

Thus, when using the exercise device 2, the full range of the abdominal muscle is exercised with the pivot point changing as the upper body of the exerciser 30 is moved forward from its backward extension or rest position through the neutral position and then to the forward position, as previously explained. Also, the exercise can be made more strenuous if the position of the exerciser 30 is reversed so that the back of the exerciser is against the steeper incline of surface 14 rather than the more gradual incline of surface 12. The sharper incline of surface 14 causes more flexing of the spine 32, requiring a greater effort by the abdominal muscles 34 to propel the torso of the exerciser 30 into the forward position.

Figure 5:
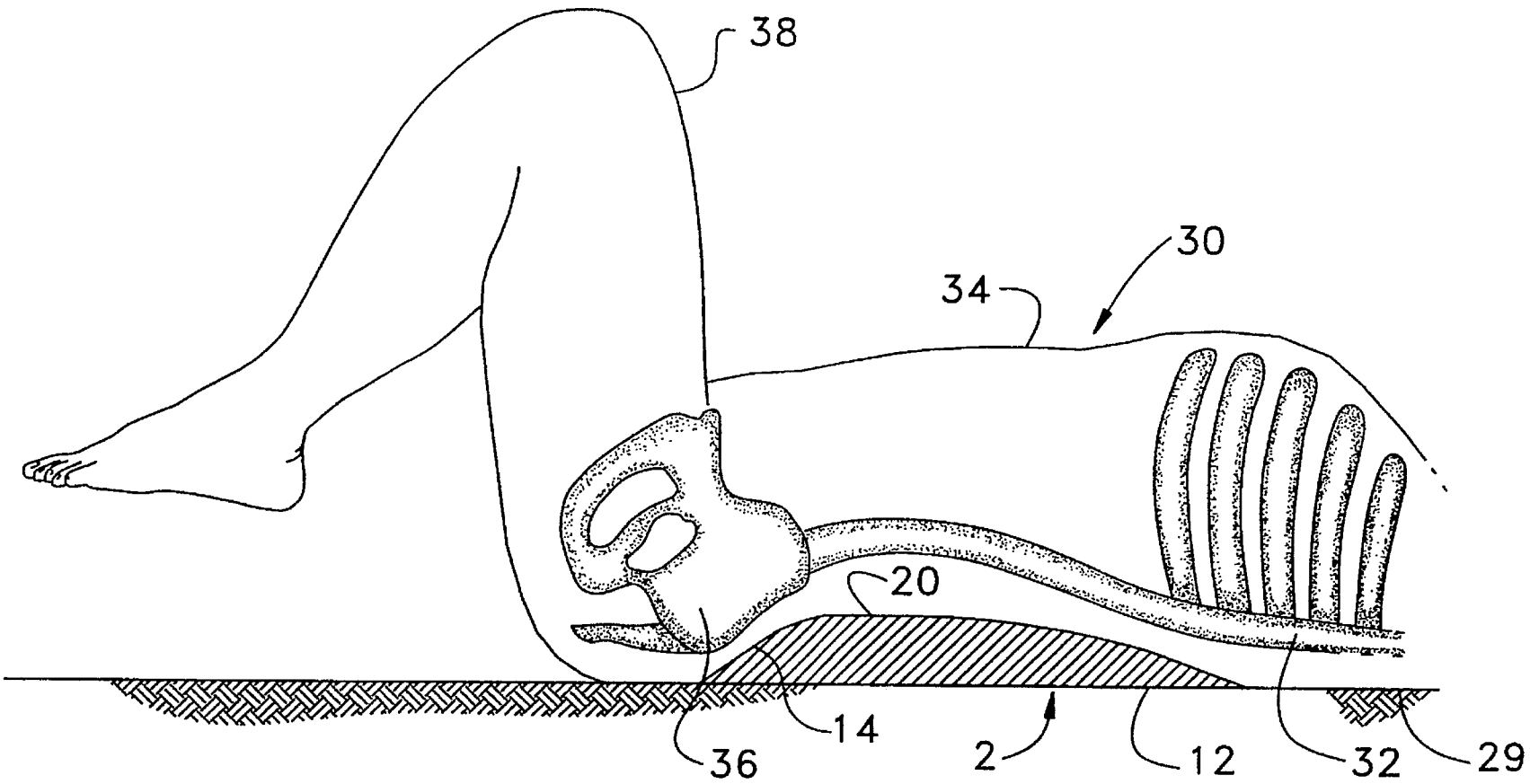
FIG. 5 shows the position of the torso and legs of the exerciser with the legs at the neutral position for exercising lower abdominal muscles.
Figure 6:
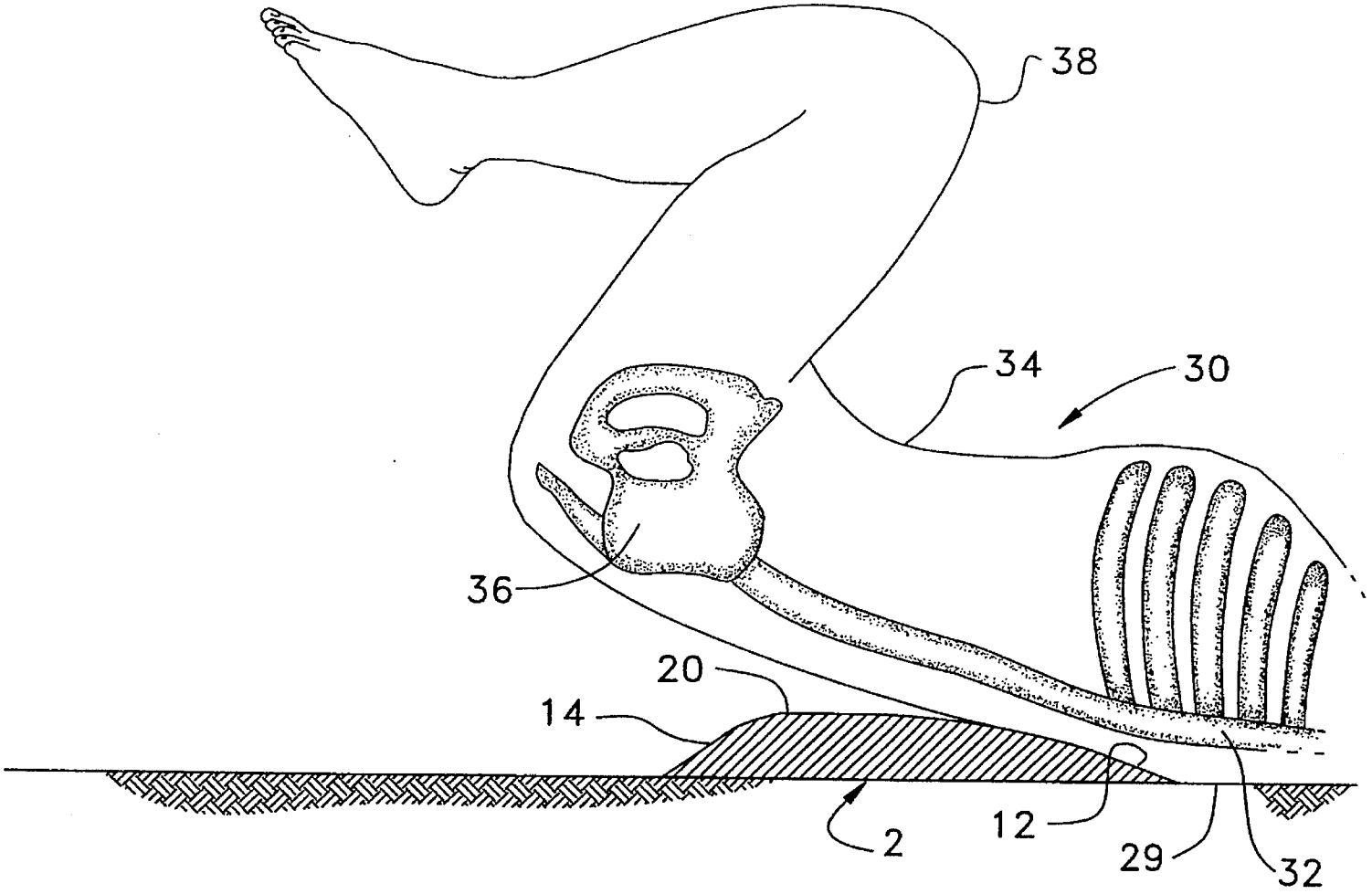
FIG. 6 shows the position of the torso and legs of the exerciser upon completion of the motion of the legs toward the torso for exercising the lower abdominal muscles.

Referring now to FIG. 5, the position of the exerciser 30 on the device 2 for exercising the lower abdominal muscles is shown. The legs 38 are shown in a partially forward or neutral position in the figure. In FIG. 6, the legs 38 of the exerciser 30 have been moved toward the upper body of the exerciser, to their forward position. The exercise is therefore performed by a forward and back motion of the legs as shown in FIGS. 5 and 6, which causes the lower abdominal muscles 34 of the exerciser 30 to be exercised through their full range of motion.

Figure 7:
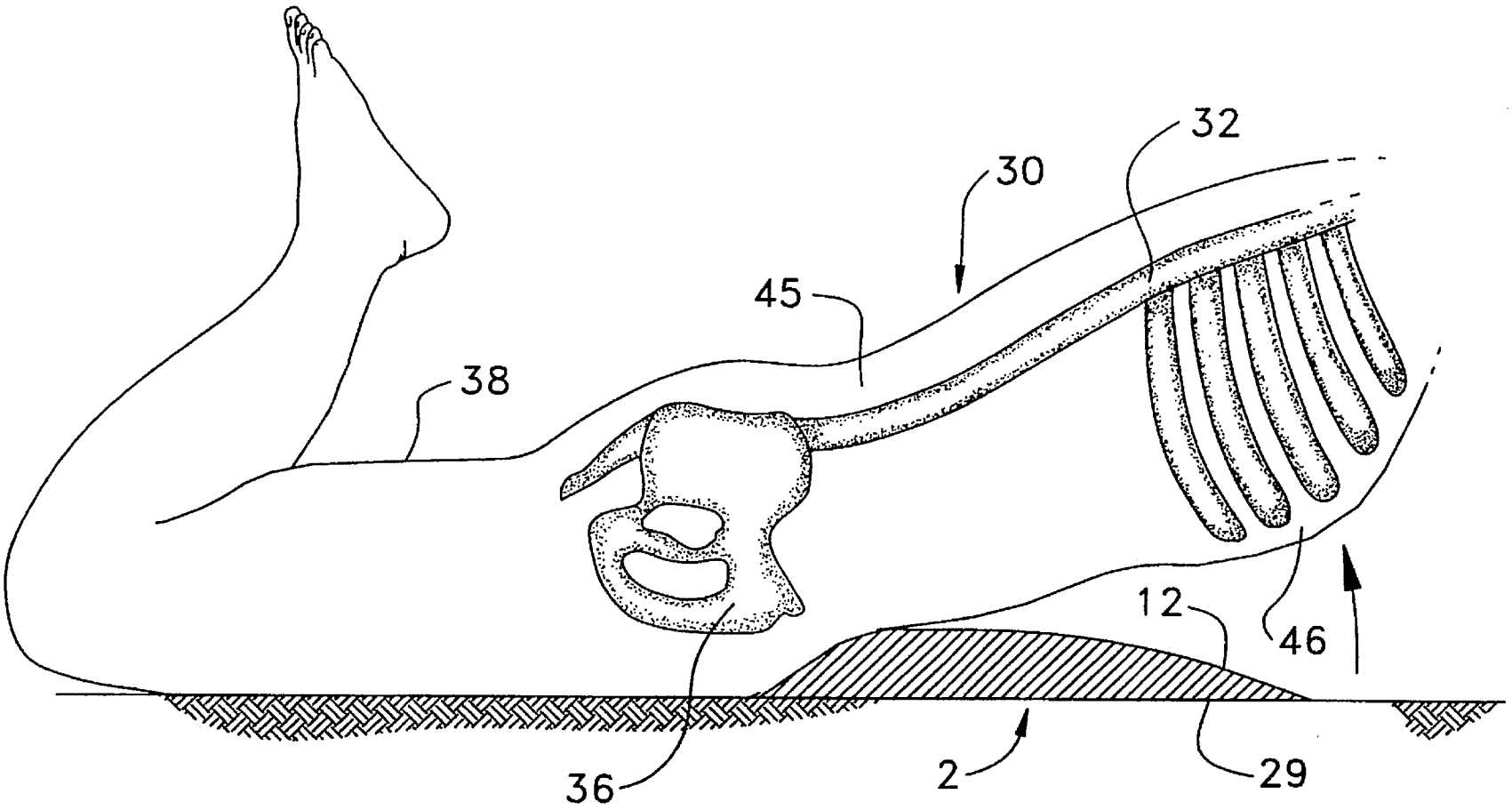
FIG. 7 shows the position of the torso and legs of the exerciser for exercising the lower back muscles of the exerciser.

In FIG. 7, the exerciser 30 is shown lying face-down on the exercise device 2 for exercising the lower back muscles 45. The legs 38 of the exerciser 30 are bent so that the foot is positioned toward the head of the exerciser as shown. To perform the exercise, the exerciser lifts his upper body 46 from the inclined surface 12 and the floor 29. The exerciser then lowers the upper torso 46 so that it lies against the inclined surface 12 and the floor 29, and then repeats the process.

Figure 8A:
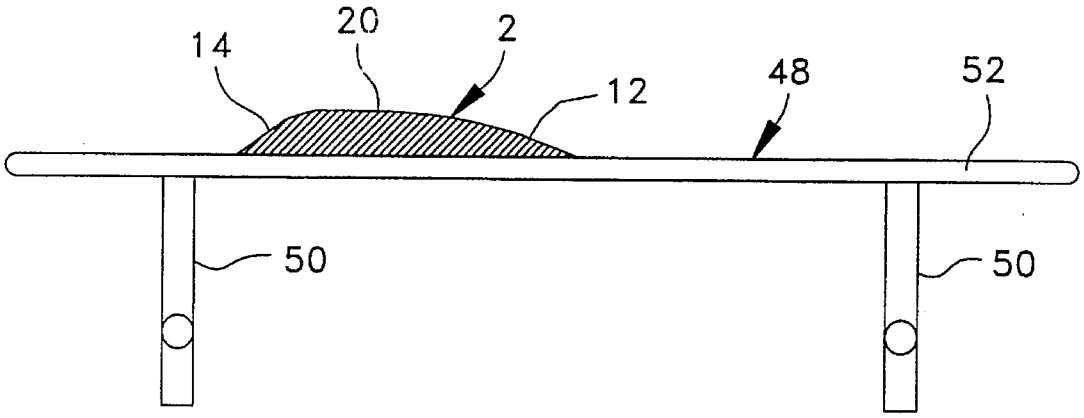
FIG. 8A shows the placement of the device for performing the exercises on a horizontal bench.
Figure 8B:
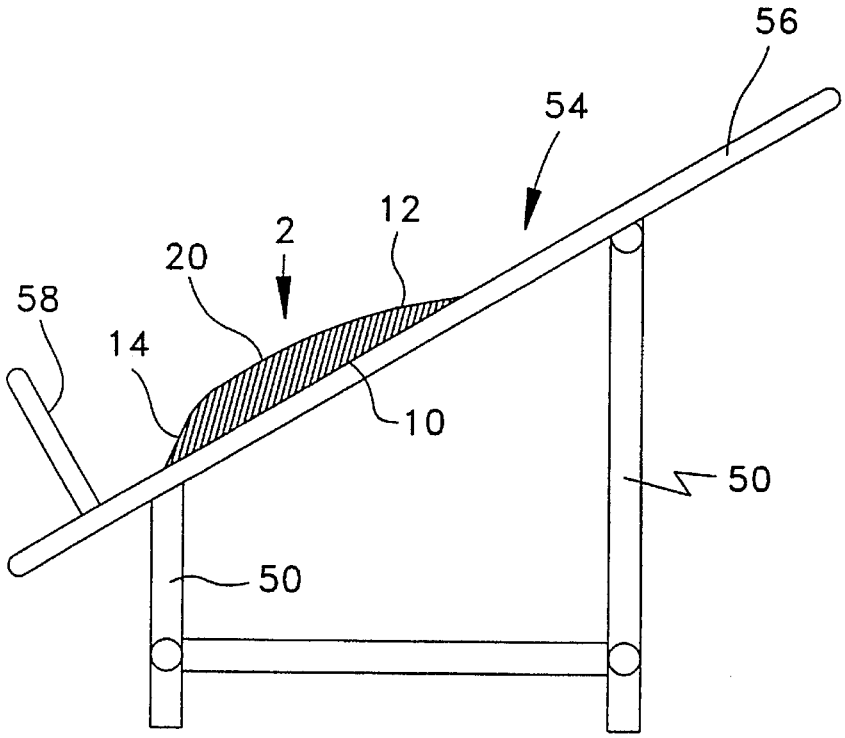
FIG. 8B shows the placement of the device for performing the exercising on an inclined bench.

FIGS. 8A and 8B illustrate the use of the device 2 on a bench. In FIG. 8A, the bench 48 has a horizontal member 52 connected to legs 50. The exercise device 2 is placed on the horizontal member 52 and the exerciser lies on the horizontal member 52 on top of the exercise device 2 to perform the various exercises which have been previously described. FIG. 8B shows the exercise device positioned on a table 54 which has an inclined member 56 positioned on legs 50. A stop member 58 is perpendicularly connected to the inclined member 56 to prevent the exerciser from sliding forward on the inclined member 56. The bottom wall 10 of the exercise device 2 can be attached with velcro or any other suitable adhesive to the surface of the inclined member 56.

An exercise device for exercising and strengthening the upper and lower abdominal muscles and the lower back muscles has been described, which is lightweight and portable, and inexpensive and easy to manufacture. The device isolates the muscles which are to be exercised and provides vigorous exercise to the muscles while preventing "cheating", wherein other muscles perform part of the exercise.

Although the use of the exercise device 2 has been described wherein the body weight of the exerciser provides the force against which the muscles work, to obtain more vigorous exercise, the exerciser 30 can use a bar bell, dumb bells, ankle weights or wrist weights to provide greater resistance. Also, the angles of the sloping end sections can be changed to accommodate the strength of the muscles of the exerciser. Finally, as is apparent from the disclosure, the device 2 may have only one inclined end section or additional end sections attached to the side walls 26.

I claim:

1. A device consisting of a single unitary member, which is free-standing, comprising first means for exercising the upper and the lower abdominal muscles and the lower back of a person said unitary member further comprising:

(a) a flat bottom wall;

(b) a pair of opposing side walls;

(c) a central section having a generally flat top surface, the plane of said top surface being generally parallel to the plane of said bottom wall;

(d) second means for causing flexion and extension of said abdominal and lower back muscles of a person; and (e) third means for providing exercise requiring more than one level of effort comprising a first and a second end section, said end sections being attached to said central section, said first and said second end sections each having a top surface inclined to said bottom wall at a first and at a second angle respectively, said first angle being larger than said second angle, so that when the legs of the person are positioned adjacent said first end section the level of exercise is greater than when the legs of the person are positioned adjacent said second end section.

2. The device of claim 1 wherein said device is portable and comprises a resilient, lightweight material.

3. The device of claim 2 wherein said top surface is rectangular in shape.

4. The device of claim 3 wherein said opposing side walls lie in planes which are generally parallel to each other and are generally perpendicular to the plane of said bottom wall.

5. The device of claim 4 wherein said first and second angles are in the range of 15° to 60°.

6. The device of claim 2 wherein said material is plastic.

7. The device of claim 2 wherein said material is elastomeric.

8. A method for exercising the upper and lower abdominal muscles and the lower back muscles of a person having legs, a back and an upper torso, using a unitary member, said unitary member comprising a bottom wall, a pair of opposing side walls, a central section having a generally flat top surface, a first and a second end section connected to said central section, said first end section having a top surface inclined at a first angle to said bottom wall, and said second end section having a top surface inclined at a second angle to said bottom wall, said method comprising the steps of:

(a) selecting a level of exercise by positioning the person with the back resting on said central section, the legs on the floor adjacent either the first end section or the second end section and the upper torso on the floor adjacent the end section other than the end section adjacent the legs;

(b) exercising the upper abdominal muscles of the person by repetitively raising and lowering the upper torso from, and to, the floor; and (c) exercising the lower abdominal muscles by raising and lowering the leas from and to the floor.

9. The method of claim 8 further including the steps of:

(a) exercising the lower back muscles by positioning the person with the abdominal muscles resting on said central section; and (b) repetitively raising and lowering the upper torso from and to the floor.

* * * * *